US009364069B2

(12) United States Patent
Han

(10) Patent No.: US 9,364,069 B2
(45) **Date of Patent: *Jun. 14, 2016**

(54) FINGERNAIL COVERINGS AND RELATED SYSTEMS AND METHODS

(71) Applicant: Kiss Nail Products, Inc., Port Washington, NY (US)

(72) Inventor: Kyu Sang Han, Port Washington, NY (US)

(73) Assignee: Kiss Products, Inc., Port Washington, NY (US)

( * ) Notice: Subject to any disclaimer, the term of this patent is extended or adjusted under 35 U.S.C. 154(b) by 4 days.

This patent is subject to a terminal disclaimer.

(21) Appl. No.: 14/504,031

(22) Filed: Oct. 1, 2014

(65) Prior Publication Data

US 2016/0029767 A1 Feb. 4, 2016

Related U.S. Application Data

(63) Continuation-in-part of application No. 14/449,805, filed on Aug. 1, 2014, now Pat. No. 9,084,466.

(51) Int. Cl.
*A45D 29/00* (2006.01)
*A45D 31/00* (2006.01)

(52) U.S. Cl.
CPC ..... *A45D 29/001* (2013.01); *A45D 31/00* (2013.01); *A45D 2029/002* (2013.01); *A45D 2031/005* (2013.01)

(58) Field of Classification Search
CPC ..... A45D 29/00; A45D 31/00; A45D 29/001; A45D 2029/002; A45D 2031/005; A45D 29/004; A45D 2029/008
USPC ..... 132/73, 285, 73.5
See application file for complete search history.

(56) References Cited

U.S. PATENT DOCUMENTS

| | | | | |
|---|---|---|---|---|
| 2,199,207 | A * | 4/1940 | Nolan | 132/73 |
| 4,007,748 | A * | 2/1977 | Matranga et al. | 132/73 |
| 4,346,720 | A * | 8/1982 | Hokama | 132/73 |
| 4,407,310 | A | 10/1983 | Jadow | |
| 4,947,876 | A | 8/1990 | Larsen | |
| 5,036,589 | A * | 8/1991 | Heinrich | 30/298 |

(Continued)

FOREIGN PATENT DOCUMENTS

| | | | |
|---|---|---|---|
| CA | 2190205 | A1 * | 5/1998 |
| CA | 2461251 | | 9/2005 |

(Continued)

OTHER PUBLICATIONS

Images of product packaging, and included related materials, of "Nail Dress" product offered for sale and/or sold in the United States by Kiss Nail Products before at least Jul. 31, 2014. Packaging includes a copyright notice of 2013.

*Primary Examiner* — Robyn Doan
(74) *Attorney, Agent, or Firm* — Jones Day

(57) ABSTRACT

In some aspects, fingernail coverings can include a flexible sheet layer configured to conform to and cover at least a portion a fingernail, the flexible sheet layer defining a first surface configured to adhere to the portion of the fingernail, and a fingernail tip extension disposed along an end region of the flexible sheet layer, the fingernail tip extension being arranged to expose an area of a second surface of the flexible sheet layer to be installed over a proximal end of the fingernail.

24 Claims, 8 Drawing Sheets

(56) References Cited

U.S. PATENT DOCUMENTS

| | | | | |
|---|---|---|---|---|
| 5,044,384 | A | 9/1991 | Hokama et al. | |
| 5,209,250 | A | 5/1993 | Taeckens | |
| 5,944,027 | A | 8/1999 | Chang | |
| 8,448,648 | B2 | 5/2013 | Han | |
| 8,561,619 | B1 * | 10/2013 | Han | A45D 31/00 132/73 |
| D705,487 | S | 5/2014 | Chang | |
| 8,757,173 | B2 | 6/2014 | Kovarik et al. | |
| 2002/0002980 | A1 | 1/2002 | Chang et al. | |
| 2005/0121048 | A1 * | 6/2005 | Han | A45D 31/00 132/73 |
| 2006/0191551 | A1 | 8/2006 | Han | |
| 2007/0107745 | A1 | 5/2007 | Kiyomoto | |
| 2008/0017213 | A1 | 1/2008 | Han | |
| 2008/0283073 | A1 | 11/2008 | Park | |
| 2008/0289646 | A1 * | 11/2008 | Fracassi | A45D 31/00 132/200 |
| 2009/0241976 | A1 * | 10/2009 | Chang | 132/200 |
| 2011/0030711 | A1 * | 2/2011 | Han | 132/73 |
| 2011/0114106 | A1 | 5/2011 | Munoz | |
| 2011/0132384 | A1 * | 6/2011 | Han | 132/73 |
| 2011/0186067 | A1 * | 8/2011 | Coppola et al. | 132/73 |
| 2013/0017352 | A1 | 1/2013 | Chang | |
| 2013/0206157 | A1 * | 8/2013 | Park | A45D 29/001 132/73 |
| 2014/0090658 | A1 | 4/2014 | Malon | |

FOREIGN PATENT DOCUMENTS

| | | |
|---|---|---|
| CN | 201700361 | 1/2011 |
| CN | 102144842 | 8/2011 |

* cited by examiner

FINGERNAIL COVERINGS AND RELATED SYSTEMS AND METHODS

CROSS-REFERENCE TO RELATED APPLICATIONS

This application is a continuation-in-part of U.S. Ser. No. 14/449,805 filed on Aug. 1, 2014 and titled "Fingernail Coverings and Related Systems and Methods," the contents of which are hereby incorporated herein by reference in their entirety.

TECHNICAL FIELD

This application relates generally to fingernail coverings, and more specifically to multi-layer artificial fingernail covers and related systems and methods.

BACKGROUND

Conventional ornamental fingernail accessories can be made from thin, molded plastic members manufactured generally in the shape of a fingernail. In some examples, the user applies a small amount of a liquid bonding adhesive to the fingernail accessory or to the natural nail and affixes the fingernail accessory to the nail. Some alternative examples include an adhesive press-on tab system for attaching artificial fingernails to the user's natural nails. The tabs can include double-sided adhesive tape with removable layers that are interposed between the artificial fingernail and the natural fingernail.

Other existing ornamental fingernails have included a pre-applied pressure sensitive layer. Some examples have included a self-adhesive laminate having an adhesive composition made of an acrylic copolymer requiring acrylic acid and titanium chelate ester. Other examples have included an artificial fingernail and method of making an artificial fingernail in which the artificial fingernail is pre-taped with an adhesive layer covered by a removable layer during the manufacturing process. The removable layer covers the adhesive layer and is removable to expose the adhesive layer for application to the natural fingernail.

Other types of conventional fingernail coverings have included a thin material layer having adhesive on one side to be adhered to a user's natural nail.

SUMMARY

In some aspects, fingernail coverings can include a flexible sticker sheet layer configured to at least partially conform to and cover a fingernail from a cuticle region at a proximal end to a distal end of the fingernail, the flexible sticker sheet layer defining a first surface configured to adhere to at least a portion of the fingernail; and a fingernail tip extension disposed along a distal end region of the flexible sticker sheet layer. The tip extension cam include a protruding region that extends proximally along the flexible sticker sheet layer away from a distal end of the fingernail covering, the protruding region extending proximally away from a remaining region of the fingernail tip extension for maintaining structural integrity of the fingernail covering and placement of the fingernail covering along the fingernail. A material stiffness of the fingernail tip extension is greater than a material stiffness of the flexible sticker sheet layer.

Embodiments can include one or more of the following:

The tip extension can have a surface area that is about 15% to about 50% of a surface area of the flexible sticker sheet layer. The tip extension can have a surface area that is about 25% to about 40% of a surface area of the flexible sheet sticker layer. The tip extension can have a maximum thickness that is about 0.002 inches to about 0.05 inches. The maximum thickness can be located at the distal end of the fingernail covering. The tip extension can be disposed along a second surface of the flexible sticker sheet layer that is opposite the first surface. The tip extension can be disposed along the first layer of the flexible sticker sheet layer. The tip extension can include a surface configured to adhere to the fingernail.

The protruding region can extend along a central region of the fingernail covering. The protruding region can extend from a remaining region of the tip extension by about 5% to about 15% of a length of the fingernail. The protruding region can have a generally curved shape.

The flexible sticker sheet layer has a generally uniform thickness. A ratio of an end thickness of the tip extension to the generally uniform thickness of the flexible sticker sheet layer can be about 2:1 to about 5:1.

The fingernail covering can include a removable layer disposed along adhesive surfaces of the flexible sticker sheet layer and/or the tip extension. The fingernail covering can include a second sticker sheet layer disposed along the first surface of the flexible sticker sheet layer and a surface of the tip extension that is opposite a surface of the tip extension that is attached to the flexible sticker sheet layer.

In some aspects, fingernail coverings can include a flexible sheet layer configured to conform to and cover at least a portion a fingernail, the flexible sheet layer defining a first surface configured to adhere to the portion of the fingernail; and a fingernail tip extension disposed along an end region of the flexible sheet layer, the fingernail tip extension being arranged to expose an area of a second surface of the flexible sheet layer to be installed over a proximal end of the fingernail.

Embodiments can include one or more of the following:

The tip extension can have a surface area that is about 15% to about 50% of a surface area of the flexible sheet layer. The tip extension can have a surface area that is about 25% to about 40% of a surface area of the flexible sheet layer. The tip extension can have a maximum thickness located at a distal end of the fingernail covering that is about 0.002 inches to about 0.05 inches. The tip extension can have one or more generally curved protruding regions that extend proximally along the sheet layer away from a distal end of the fingernail covering. One or more of the protruding regions can extend along a central region of the fingernail covering. The protruding region can have a width that is about 15% to about 50% of a total width of the fingernail covering. An elastic modulus of a fingernail tip extension material can be greater than an elastic modulus of the flexible sheet layer. A ratio of a maximum thickness of the tip extension to a generally uniform thickness of the flexible sheet layer can be about 2:1 to about 5:1. The tip extension can be disposed along a second surface of the flexible sheet layer that is opposite the first surface. The tip extension can be disposed along the first layer of the flexible sheet layer. The tip extension can include a surface configured to adhere to the fingernail.

The fingernail covering can include a removable liner layer disposed along adhesive surfaces of the flexible sheet layer and/or the tip extension.

The fingernail covering can include a second sticker layer disposed along the first surface of the flexible sheet layer and a surface of the tip extension that is opposite a surface of the tip extension that is attached to the flexible sheet layer.

In some aspects, assemblies can include can include a liner sheet; and a plurality of fingernail coverings releasably disposed along the liner sheet, at least one of the plurality of fingernail coverings comprising: a flexible sheet layer configured to conform to and cover at least a portion a fingernail, the flexible sheet layer defining a first surface configured to adhere to the portion of the fingernail; and a fingernail tip extension disposed along an end region of the flexible sheet layer, the fingernail tip extension being arranged to expose an area of a second surface of the flexible sheet layer to be installed over a proximal end of the fingernail.

In some aspects, fingernail coverings can include a flexible sticker sheet layer configured to conform to at least a portion of and cover a fingernail from a cuticle region at a proximal end to a distal end of the fingernail, the flexible sticker sheet layer defining a first surface configured to adhere to the fingernail; a removable liner layer disposed along the first surface of the flexible sticker sheet layer; and a fingernail tip extension disposed along a distal end region of the flexible sticker sheet layer (e.g., along a second surface of the flexible sticker sheet layer that is opposite the first surface), the fingernail tip extension being arranged along the second surface to expose an area of the second surface to be installed over the proximal end of the fingernail, wherein the tip extension includes a protruding region that extends proximally along the flexible sticker sheet layer away from a distal end of the fingernail covering, the protruding region extending proximally away from a remaining region of the fingernail tip extension for maintaining structural integrity of the fingernail covering and placement of the fingernail covering along the fingernail, wherein a material stiffness of a fingernail tip extension is greater than a material stiffness of the flexible sticker sheet layer.

Embodiments can include one or more of the following features.

The tip extension can cover about 15% to about 50% of the flexible sticker sheet layer. The tip extension can cover about 25% to about 40% of the flexible sheet sticker layer. The tip extension can have a thickness (e.g., a maximum thickness) that is about 0.002 inches to about 0.05 inches. The maximum thickness can be located at the distal end of the fingernail covering.

The protruding region can extend along a central region of the fingernail covering. The protruding region can extend from a remaining region of the tip extension by about 5% to about 15% of a length of the fingernail. The protruding region can have a first width that is about 15% to about 50% of a total width of the fingernail covering. The protruding region can have a generally curved shape.

In an installed configuration, the tip extension can extend off of the distal end of the fingernail.

The elastic modulus of the tip extension material is about 0.5 gigapascals to about 10 gigapascals.

The flexible sticker sheet layer can have a generally uniform thickness. A ratio of an end thickness of the tip extension to the generally uniform thickness of the flexible sticker sheet layer can be about 2:1 to about 5:1.

The removable liner layer can include a sheet along which the flexible sticker sheet layer is releasably adhered.

A transition angle can be defined between the second surface of the flexible sticker sheet layer and an exterior surface of the tip extension. The transition angle can be at least 150 degrees.

In some aspects, fingernail coverings can include a flexible sheet layer configured to at least partially conform to and cover a fingernail, the flexible sheet layer defining a first surface configured to adhere to the fingernail; and a fingernail tip extension disposed along an end region of the flexible sticker sheer layer (e.g., a second surface of the flexible sheet layer that is opposite the first surface), the fingernail tip extension being arranged along the second surface to expose an area of the second surface to be installed over a proximal end of the fingernail.

Embodiments can include one or more of the following features.

The tip extension can cover about 15% to about 50% of the flexible sheet layer. The tip extension can cover about 25% to about 40% of the flexible sheet layer.

The tip extension can have a thickness (e.g., a maximum thickness) located at a distal end of the fingernail covering that is about 0.002 inches to about 0.05 inches.

The tip extension can include one or more generally curved protruding regions that extend proximally along the sheet layer away from a distal end of the fingernail covering. One of the protruding regions can extend along a central region of the fingernail covering. The protruding region can have a width that is about 15% to about 50% of a total width of the fingernail covering.

The elastic modulus of the fingernail tip extension material can be greater than an elastic modulus of the flexible sheet layer, where the elastic modulus of the fingernail tip extension can be about 0.5 gigapascals to about 10 gigapascals.

A ratio of an end thickness of the tip extension to a generally uniform thickness of the flexible sheet layer can be about 2:1 to about 5:1.

A removable liner layer can be disposed along the first surface of the flexible sheet layer.

In some aspects, an assembly can include a liner sheet; and a plurality of fingernail coverings releasably disposed along the liner sheet. At least one of the plurality of fingernail coverings can include a flexible sticker sheet layer configured to at least partially conform to and cover a fingernail from a cuticle region at a proximal end to a distal end of the fingernail, the flexible sticker sheet layer defining a first surface configured to adhere to the fingernail; a removable liner layer disposed along the first surface of the flexible sticker sheet layer; and a fingernail tip extension disposed along a distal end region of the flexible sticker sheet layer (e.g., a second surface of the flexible sticker sheet layer that is opposite the first surface), the fingernail tip extension being arranged along the second surface to expose an area of the second surface to be installed over the proximal end of the fingernail, the tip extension comprising: a protruding region that extends proximally along the flexible sticker sheet layer away from a distal end of the fingernail covering, the protruding region extending proximally away from a remaining region of the fingernail tip extension for maintaining structural integrity of the fingernail covering and placement of the fingernail covering along the fingernail, wherein a material stiffness of the fingernail tip extension is greater than a material stiffness of the flexible sticker sheet layer.

It is noted that while the term "fingernail" is used throughout this application, the term is intended to cover nails on both a user's fingers and toes.

Embodiments described herein can have one or more of the following advantages.

In some aspects, the fingernail coverings described herein, having a flexible material layer (e.g., sticker layer) that covers a natural fingernail with a tip extension at a distal end of the fingernail covering (e.g., along top of the sticker layer), can be more comfortable for a user to wear than some conventional artificial fingernails. For example, some artificial fingernails made from a plastic structure intended to cover an entire fingernail can cause discomfort or other undesired sensations at the fingertips of a user as molded artificial fingernails may have the tendency to slightly pull a user's underlying fingernail into the shape and curvature of the artificial nail. In contrast, the fingernail coverings described herein are expected to be more comfortable for the user, at least, because a thin sticker layer to cover a significant portion (e.g., a majority portion) of the underlying natural fingernail, rather than a more rigid plastic covering, allows for a more flexible and that is able to more readily conform to a shape and curvature of a natural fingernail.

Additionally, the fingernail coverings described herein can be more comfortable for a user to wear because the sticker layer can be lighter than an artificial fingernail made of a full plastic covering. The lighter weight of the fingernail coverings described herein is expected to help the fingernail covering be less noticeable and more comfortable for a user.

The fingernail coverings described herein may also be more desirable to a user than some other conventional artificial fingernails (e.g., conventional fingernail stickers) by including a fingernail tip extension that can enhance the appearance of the underlying fingernail as the tip extension can make the user's fingernails to appear longer and, in some cases, more consistent with one another.

The fingernail coverings described herein may also be easier to apply to a user's fingernail than some other artificial fingernails, particularly artificial fingernails or fingernail tips that are connected to the fingernail using an adhesive. That is, by using a sticker layer, the fingernail coverings described herein with a fingernail tip extension may be attached to the user's finger more quickly and requiring less effort than artificial fingernail tips that need to be glued to the underlying natural fingernail. In some cases, the sticker layers may help enhance the appearance of the user's fingernails because the tip extension and the sticker layer (e.g., underlying and/or overlaying sticker layer) may be made to have a similar, consistent appearance so that the user may simply apply the fingernail covering to the fingernail without requiring any additional blending (e.g., smoothing or sanding) or painting, which may be required with other artificial fingernails. Also, by covering the entire underlying fingernail with the sticker layer (and/or the tip extension), the entire fingernail covering may have a more natural appearance than some existing artificial fingernail tips because the full sticker layer may help to make it more difficult to see an obvious outline along the transition between the natural fingernail and the covering.

Further, the tip extension and the sticker layer can be manufactured to have a smooth transition (e.g., blended, tapered region) therebetween to appear as one blended, smooth covering. The smooth transition can mimic a blended, sanded transition between a natural nail and a glued-on artificial fingernail tip without requiring the effort and skill that may be needed to create a natural appearance with the glued-on artificial fingernail tip. Additionally or alternatively, the fingernail covering can include a sticker layer along top of (e.g., overlaying) the tip extension. In some cases, an overlaying sticker can also help to produce a smooth, consistent appearance.

DETAILED DESCRIPTION

In some aspects, the fingernail coverings described herein can include a fingernail tip extension (e.g., a plastic tip) attached to an end of a flexible material layer (e.g., sticker layer) that covers a natural fingernail, which can be more comfortable for a user to wear, and in some cases easier to apply, than some conventional artificial fingernails.

Figure 2:
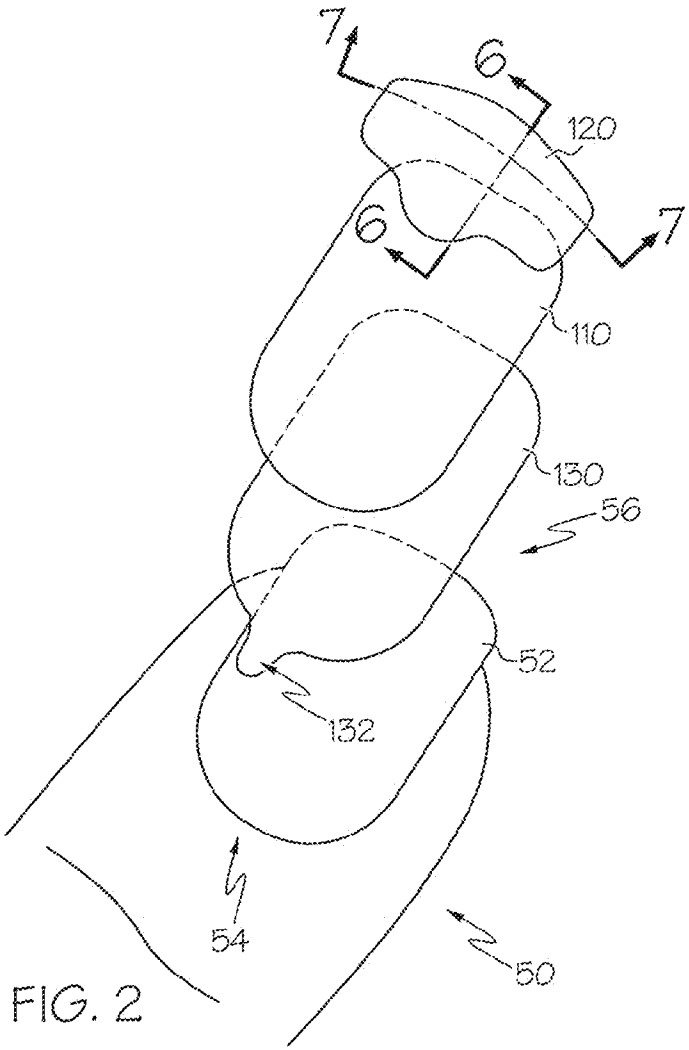
FIG. 2 is an exploded perspective view of the example fingernail covering of FIG. 1.
Figure 1:
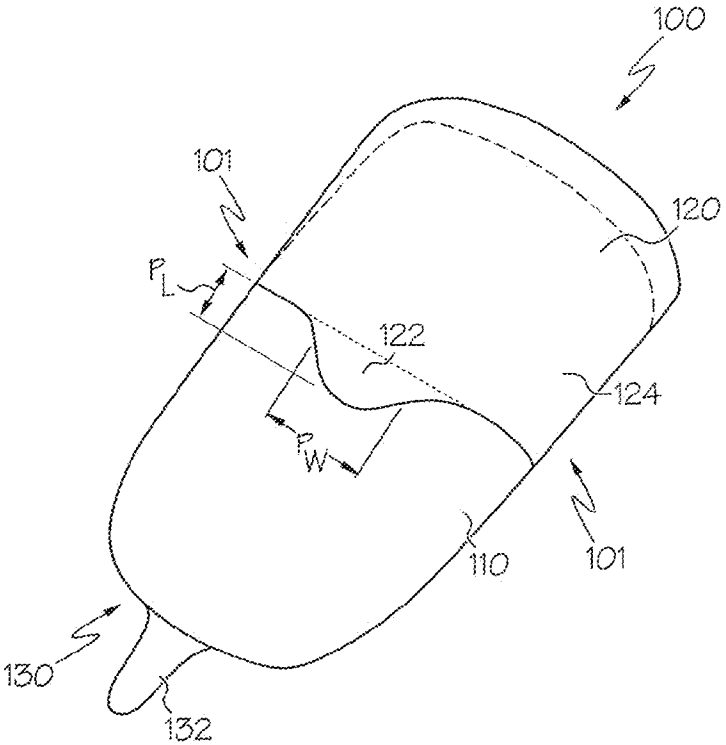
FIG. 1 is a perspective view of an example fingernail covering having a flexible layer to cover a user's natural fingernail and a tip extension along a distal end of the flexible layer.

For example, referring to FIGS. 1 and 2, a fingernail covering (e.g., an artificial fingernail) 100 can include a flexible material layer 110 with a fingernail tip layer 120 attached along a surface (e.g., a top surface) of the flexible material layer 110. The fingernail covering 100 is configured to be attached to a user's finger 50, for example, to cover a natural nail 52 at an end of the finger tip.

The flexible material layer (e.g., flexible sticker sheet layer (e.g., sticker layer)) 110 is configured to cover a natural nail (e.g., fingernail) 52 from a cuticle region at a proximal end 54 of the fingernail to a distal end 56 of the fingernail. In some embodiments, the sticker layer 110 covers the entire exposed (e.g., viewable) surface of the fingernail. For example, in some embodiments, the sticker layer 110 can be configured to cover a majority (e.g., at least 50%, 60%, 70%, 80%, 90%, 95%, or more) of the underlying fingernail. The sticker layer 110 is also configured to conform to at least a portion of the user's fingernail 52. That is, the sticker layer 110 is typically flexible and pliable such that it can adapt and conform to a native (e.g., natural) shape of the fingernail 52. For example, in some embodiments, the sticker layer 110 can be applied onto the fingernail 52 and adhere to the fingernail without substantially changing or distorting the shape or curvature of the fingernail 52. As discussed above, this feature of the fingernail covering 100 is expected to help make the fingernail coverings described herein be more comfortable to wear than some other conventional artificial fingernails.

The sticker layer 110 can be made from any of various types of structurally suitable materials. Examples of suitable sticker layer materials include thin polymer materials (e.g., thin layers of PVC) with one or more adhesives, such as acrylates (e.g., ethylhexyl acrylate copolymers) along one side. In some embodiments, the sticker layer 110 is typically formed of a material sheet having a generally consistent (e.g., uniform) material thickness 114. Alternatively, in some examples, the sticker layer can include a textured surface finish, which may be used to depict any of various designs or patterns on the fingernail covering.

The sticker layer 110 can have an average thickness that is less than about 0.025 inches (e.g., less than about 0.020 inches, 0.015 inches, 0.01 inches, or 0.005 inches). In some examples, the sticker layer can have an average thickness that is about 0.004 inches to about 0.012 inches (e.g., about 0.004 inches to about 0.007 inches).

The sticker layer 110 is also configured to be attached (e.g., adhered) to the fingernail 52. In some examples, the sticker layer has a surface, such as an adhesive surface having one or more adhesives arranged thereon to help the sticker layer and the rest of the fingernail covering adhere to the fingernail 52. For example, an amount of acrylate, such as ethylhexyl acrylate copolymer type adhesives may be pre-applied to a bottom surface 112 of the sticker layer 110.

The fingernail tip layer (e.g., fingernail tip extension) 120 is disposed along an end region (e.g., a distal end region) of a surface of the sticker layer 110, which can be an exposed surface of the sticker surface generally opposite the surface configured to adhere to the fingernail 52. However, as discussed below, other configurations are possible in which one or more sticker layers are disposed along a top surface of the tip extension. As illustrated, the tip extension 120 is disposed and arranged at an end of the sticker layer 110 to expose an area of the sticker layer 110 along the fingernail 52. In some cases, the entire sticker layer 110 can be exposed. The tip extension 120 can be attached to the sticker layer 110 by any of various suitable techniques or methods. For example, the tip extension 120 can be connected to the sticker layer 110 using any of various adhesives. Alternatively or additionally, in some examples, the sticker layer 110 may be attached to the tip extension 120 when it is being formed. For example, the tip extension 120 may be molded directly onto the sticker layer 110 to bond the two layers together.

The tip extension 120 is typically sized and shaped to mimic an actual fingernail extending from the user's nail bed. In some cases, the tip extension helps make the user's fingernail appear to be longer, more uniform, and more aesthetically pleasing than the user's natural nail. Alternatively or additionally, the tip extension may be used merely to make the user's fingernail (e.g., or a tip of the user's fingernail) a different color, for example, to replicate a French manicure in which an end tip portion of the fingernail has a different color than the remainder of the fingernail, which is typically the natural color of the fingernail bed.

As discussed above, the tip extension 120 is sized and configured so that a portion of the underlying fingernail 52 is covered only by the sticker layer 110 to help make the fingernail covering more comfortable to wear and, in some cases, easier to apply. For example, in some embodiments, the tip extension has surface area that is about 5% to about 60% (e.g., 15% to about 50%, e.g., 25% to about 40%) of a surface area of the flexible sticker layer. That is, in some embodiments, the tip extension is sized so that a portion of the sticker layer remains exposed and visible. For example, in some embodiments, at least about 40% to at least about 90% (e.g., at least 50%, 60%, 70%, 75%, 80%, or 90%) can remain exposed and visible. In some embodiments, the tip extension may have a surface area that is a portion of the sticker layer, the sticker layer can be disposed along a top region of the tip extension so that substantially all (e.g., 100%) of the sticker layer remains exposed and visible.

Figure 3:
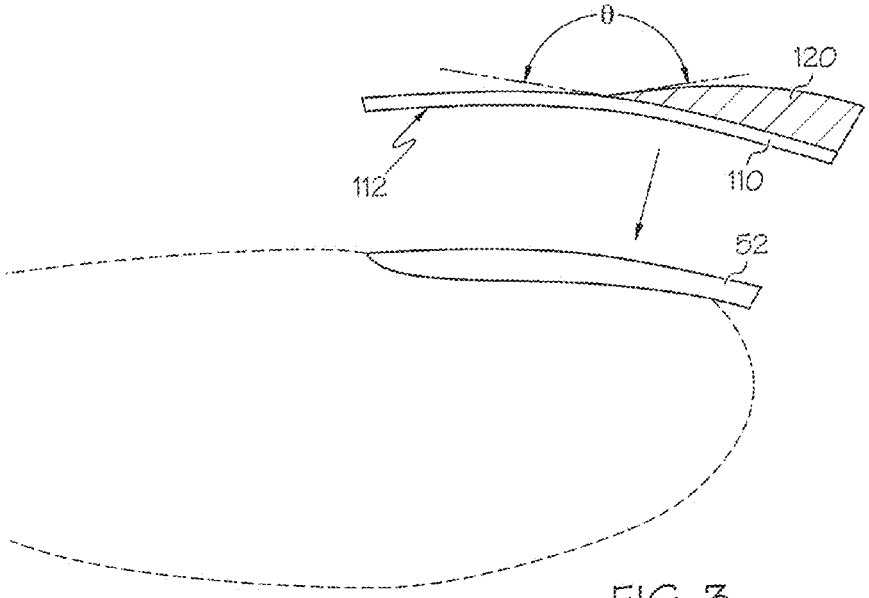
FIG. 3 is a cross-sectional side view of an example fingernail covering illustrating a transition between the flexible layer and the tip extension.
Figure 4:
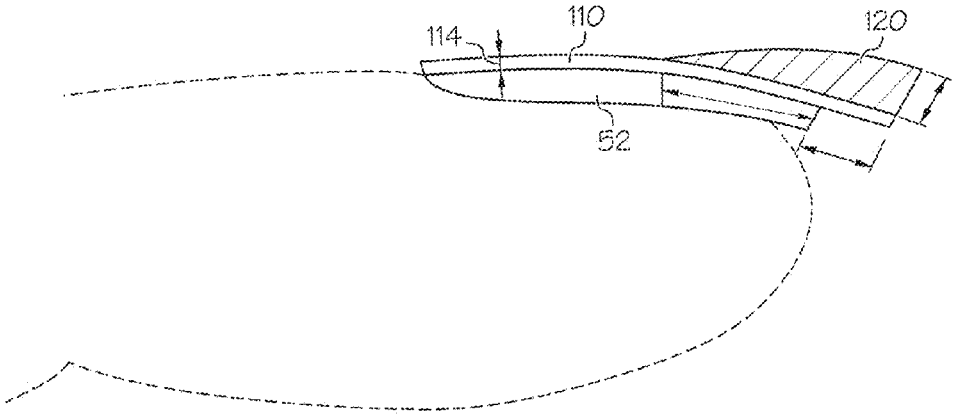
FIG. 4 is a cross-sectional side view of an example fingernail covering applied to a natural nail illustrating a flexible layer extending to a distal end of the fingernail covering.
Figure 5:
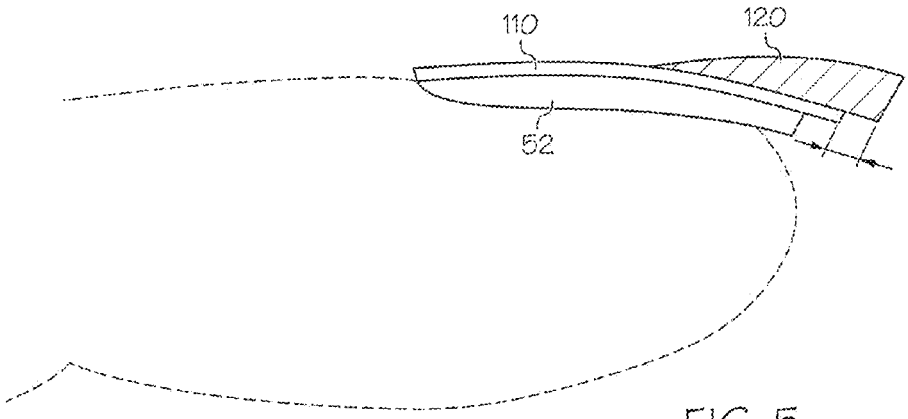
FIG. 5 is a cross-sectional side view of an example fingernail covering applied to a natural nail illustrating an end gap between a flexible layer and a distal end of the fingernail covering (e.g., the tip extension).

As discussed above, in some embodiments, the fingernail covering 110 can be designed and configured to imitate a natural fingernail having a smooth transition between the sticker layer 110 and the tip extension 120. However, in some cases, there may be a visible (i.e., noticeable upon inspection (e.g., only upon close inspection)) transition between the sticker layer 110 and the tip extension 120. Briefly referring to FIG. 3, a transition angle (0) may be present at a joint between the top, exposed surface of the sticker layer 110 and the tip extension 120. For example, the transition angle (0) can be at least 150 degrees (e.g., at least 160 degrees, 170 degrees, or 175 degrees). In some cases, there may be a smooth transition between the sticker layer 110 and the tip extension. It is noted that while the transition angles provided here are possible, the tip extensions may be modified slightly to remove sharp edges and still maintain the example transition angles.

Figure 6:
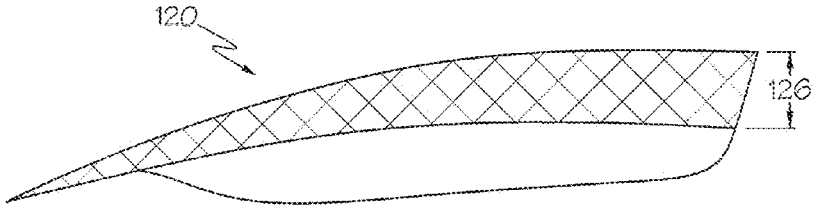
FIG. 6 is a cross-sectional side view of a tip extension layer illustrating an example tapered shape with a maximum thickness along its distal end.
Figure 7:
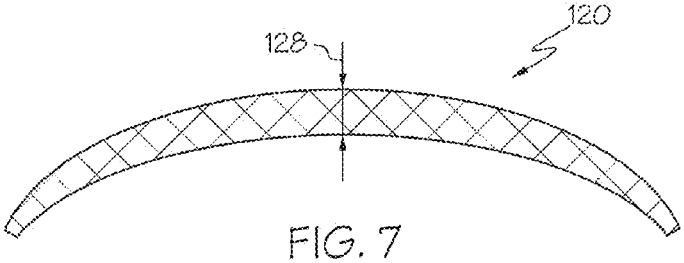
FIG. 7 is a cross-sectional front view of a tip extension layer illustrating a varying thickness throughout the tip extension with a maximum thickness along its central region.
Figure 8:
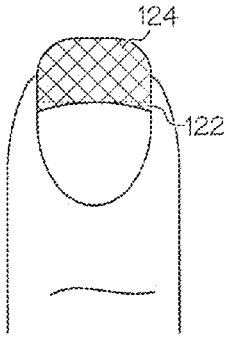
FIGS. 8-16 are top views of different example fingernail coverings installed onto fingers illustrating various example protruding region designs and configurations.
Figure 9:
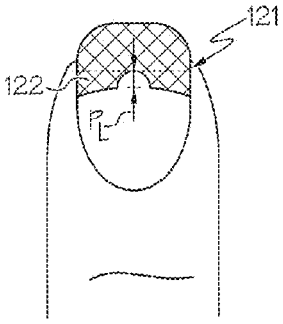
Figure 10:
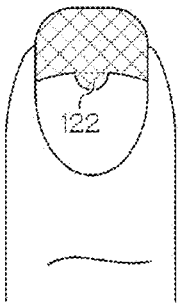
Figure 11:
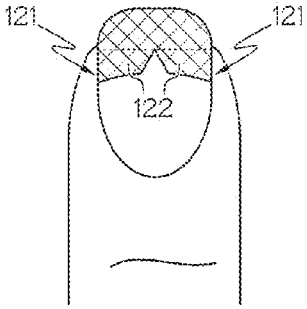
Figure 12:
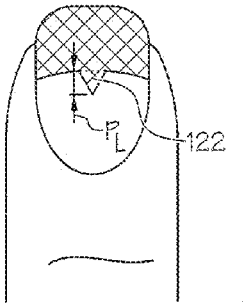
Figure 13:
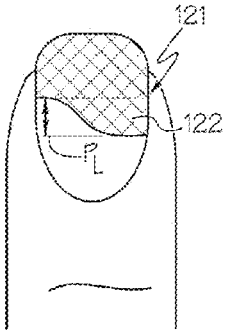
Figure 14:
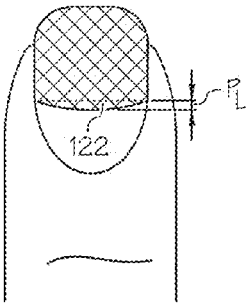
Figure 15:
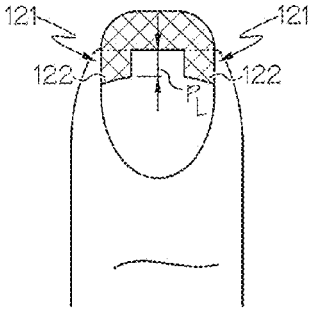
Figure 16:
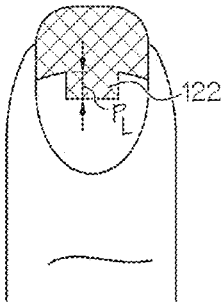

Referring also to FIGS. 6 and 7, a tip extension can have a thickness that varies along its length (FIG. 6) or width (FIG. 7). As illustrated in FIG. 6, in some embodiments, the tip extension has a maximum thickness 126 along its length, which can be arranged at a distal end of the tip extension. In some embodiments, the maximum thickness 126 of the tip extension can be in a region other than the distal end. For example, in some cases, the thickness of the tip extension 120 can increase from both the proximal and distal ends to a maximum region in a inner area (e.g., away from a peripheral region) of the tip extension. That is, along its length, the thickness of the tip extension can increase to a maximum thickness and continue to taper towards the distal end. In some examples, the maximum thickness 126 can be at least 0.01 inches to about 0.05 inches (e.g., about 0.025 inches to about 0.04 inches). In some embodiments, a ratio of a thickness (e.g., an end thickness) of the tip extension to the generally uniform thickness of the flexible sheet layer can be about 2:1 to about 5:1.

As illustrated in FIG. 7, the tip extension can also have a thickness that varies along its width. For example, in some embodiments, the tip extension can have a thickness that, with respect to its width, tapers (e.g., decreases) from a maximum thickness 128 along its width in its central region towards its side edges.

The tip extension can be made of any of various structurally suitable materials. As discussed above, the tip extension is typically formed of a material that is configured to appear and behave like a natural fingernail. In some embodiments, the tip extension can be formed of a stiffer material (e.g., stiffer than the sticker layer) that is configured to remain structurally stable when extending off of the fingernail. Examples of suitable materials can include any of various types of plastics, such as acrylonitrile butadiene styrene (ABS), polyvinyl chloride (PVC), nylon, or various other plastics. In some embodiments, the material used for the tip extension can have a modulus of elasticity (e.g., elastic modulus) that is about 0.5 gigapascals (GPa) to about 10 GPa.

As discussed above, the fingernail covering (e.g., in an installed, worn configuration) is typically configured to extend off of a distal end of the user's natural fingernail. For example, the fingernail covering can extend off of the fingernail by at least about 0.05 inches (e.g., about 0.075 inches, 0.1 inches, or more). In some cases, the fingernail covering can extend off of the fingernail by a length that is at least about 5%

(e.g., at least about 10%, 20% or 30%) of a length of the underlying fingernail or of a length of the fingernail covering itself.

Referring to FIGS. 1 through 7, the tip extension 120 can include a protruding region 122 that extends proximally (e.g., inwardly toward the cuticle region) along the flexible sticker layer away from a distal end (e.g., tip end) of the fingernail covering. The protruding region 122 can extend inwardly away from a remaining region 124 of the fingernail tip extension to, in some cases, help make the fingernail covering stronger and more stable during use when installed on a fingernail. For example, when installed on a fingernail, when a force is applied to a distal end region of the tip extension 120, the protruding region 122 may serve to provide a resistant force that limits the tip extension from bending or pulling up off of the fingernail. In some cases, the protruding region can also help with placement of the fingernail covering along the natural fingernail by serving as a contact region to be placed against the fingernail.

The protruding region 122 can extend away from the remaining region 124 (e.g., axially) by a protrusion lengths $P_L$, which can be any of various lengths. For example, the protrusion length $P_L$ can be about 5% to about 50% (e.g., about 10% to about 40%, e.g., about 20% to about 35%) of a total length of the tip extension 120. In some embodiments, the protrusion length $P_L$ can be at least about 0.05 inches (e.g., about 0.05 inches to about 0.1 inches, e.g., about 0.05 inches to about 0.15 inches).

The protruding region 122 can also have any of various widths $P_W$. For example, in some embodiments, the protrusion width $P_W$ can be at least about 10% (e.g., about 15% to about 70%, e.g., about 25% to about 50%) of a total width of the tip extension and/or fingernail covering. In some examples, the protrusion width can be about 0.05 inches to about 0.25 inches (e.g., 0.1 inches to about 0.225 inches or about 0.125 inches to about 0.2 inches).

In some embodiments, as illustrated in FIGS. 1 and 2, the protruding region 122 extends along a central region of the fingernail covering. Additionally, in some examples, the protruding region 122 can have a generally curved (e.g., rounded) shape extending from the remaining region 124.

However, other shapes and configurations of protruding regions are possible. For example, referring to FIGS. 8-16, tip extensions can include one or more protruding regions having any of various shapes formed of curved or straight profiles. Examples include angled profiles having a "v-shaped" edge, a stepped or square edged profile, a trapezoidal profile, a tapered profile, or any of various other shapes. Additionally, while FIGS. 1 and 2 illustrate only one, centrally formed protruding region, the tip extension can include one or more protruding regions along the side regions 121 of the tip extension.

While the fingernail coverings have been generally illustrated, for simplicity and clarity of description, as having the tip extension 120 disposed along the top, exposed surface of sticker layer, other configurations are possible as described herein. For example, specifically referring to FIGS. 24 and 25, sticker layers can be disposed along a top surface of the tip extension so that the entire sticker layer is exposed.

Figure 24:
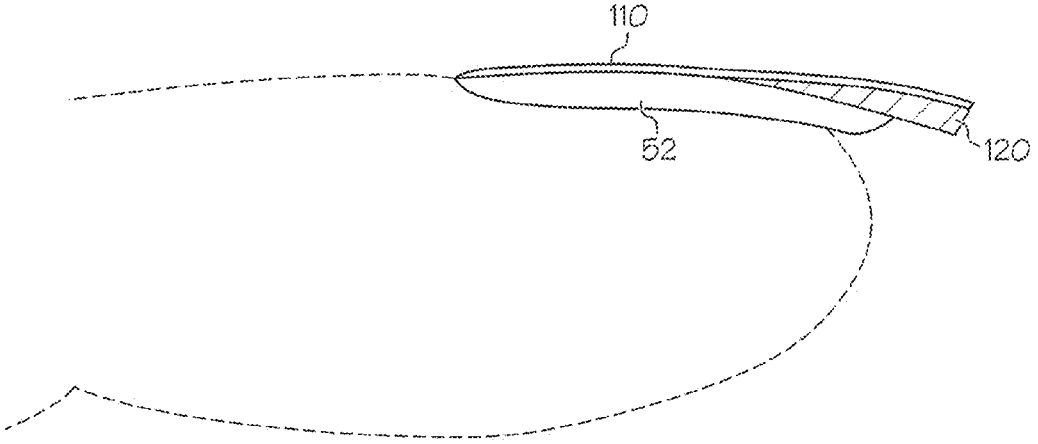
FIG. 24 is a cross-sectional side view of an example fingernail covering applied to a natural nail, where the fingernail covering includes a flexible layer overlaying a tip extension along a natural nail.

Referring to FIG. 24, in some embodiments, the fingernail covering can include a tip extension 120 that has a bottom surface configured to adhere (e.g., using one or more of the adhesives described herein) to the natural nail 52. Along its top surface opposite the surface configured to adhere to the natural nail 52, the tip extension can be connected to the sticker layer 110. As discussed above, the tip extension 120 and sticker layer 110 can be bonded (e.g., using an adhesive) or can be manufactured together as an integral unit.

The sticker layer 110 can also be configured to temporarily bond to the natural nail 52, for example, along the bottom surface of the sticker layer that is not attached to the tip extension 120. In some embodiments, the bottom surfaces of the sticker layer and tip extension can include a consistent adhesive so that both components can be substantially uniformly attached and remain bonded to the natural nail for a desired time. In some embodiments, the tip extension and the sticker layer may have different types of adhesives (e.g., based on the materials used for each layer).

Figure 25:
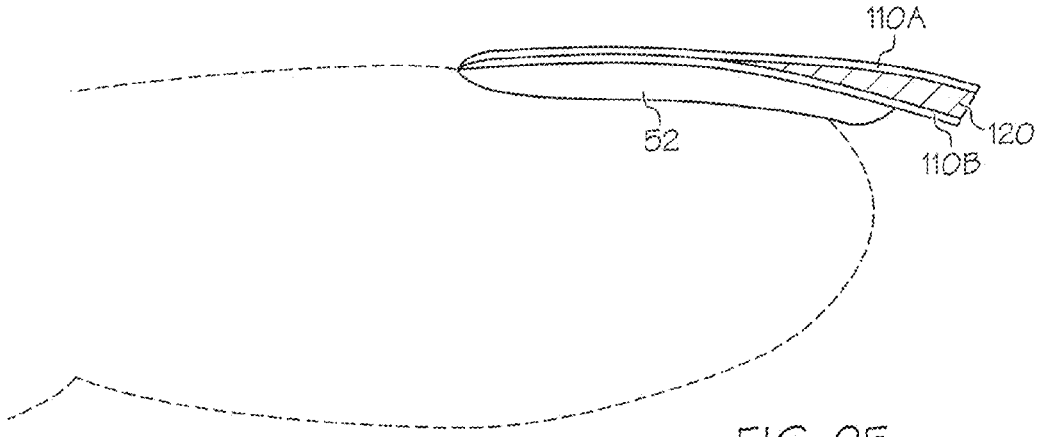
FIG. 25 is a cross-sectional side view of another example fingernail covering applied to a natural nail, where the fingernail covering includes a tip extension disposed between two flexible layers.

The fingernail coverings can also include more than one sticker layers. Referring to FIG. 25, in some embodiments, the fingernail covering can include a second flexible sticker sheet layer 110B disposed along the first surface of the first flexible sticker sheet layer 110A and a surface of the tip extension 120 that is opposite a surface of the tip extension 120 that is attached to the first flexible sticker sheet layer 110A. Therefore, in the embodiments, the first sticker sheet layer 110A is disposed along top of the tip extension 120 and the second (e.g., bottom, underlying) sticker sheet layer 110B. In some embodiments, the first sticker sheet layer 110A can be sized to cover the tip extension 120 and the entire second sticker sheet layer 110B. In some embodiments, the multiple sticker layers (e.g., the two sticker layers 110A, 110B) can be formed in different sizes (e.g., different lengths or surface areas). In some cases, the first sticker sheet layer 110A can be formed to cover only a portion of the tip extension 120 and/or the second sticker sheet layer 110B. In some cases, the first sticker sheet layer 110A can extend from the distal end of the fingernail covering (e.g., to the distal end of the tip extension) to a region between the cuticle end of the fingernail covering (e.g., the proximal end of the second sticker sheet layer 110B) and the proximal end of the tip extension 120.

Remaining features and characteristics of the fingernail coverings illustrated and described with respect to FIGS. 24 and 25 in which a sticker layer is disposed over top of a tip extension can otherwise be similar or the same as those described with the embodiments depicted in FIGS. 1-16 including but not limited to certain lengths, sizes, and shapes of any of the particular layers relative to one another, as well as the possible presence and orientation of one or more protruding regions 122 as described and illustrated herein.

Referring back to FIGS. 1-2, the fingernail covering 100 can also include a removable layer 130 that can be used to cover and protect the adhesive surface of the sticker layer 110. For example, the removable layer 130 can help limit the sticker layer 110 or the tip extension 120 from inadvertently becoming adhered to a surface prior to installing the fingernail covering onto a fingernail.

For example, in some embodiments, the removable liner layer 130 can be dedicated for use with just one fingernail covering. The individual removable liner layers can therefore be removed one-at-a-time from a fingernail covering before the fingernail covering is applied to a user's fingernail. In some embodiments, a removable liner layer can include one or more tab regions 132 configured to be gripped to remove the removable liner layer from the sticker layer 110 and/or the tip extension 120. For example, the tab region 132 can be arranged at a proximal (i.e., cuticle region) of the fingernail covering. In some cases, the tab region 132 can extend beyond a peripheral region of the sticker layer 110 or the tip extension 120 so that it can be grasped by a user. As discussed below, in some cases, the fingernail covering can be gripped by the tip extension with one hand (e.g., the opposite from which the fingernail covering is to be installed) and the removable liner layer can be removed with the hand on which the fingernail covering is to be installed. Then, without having to release the tip extension, the fingernail covering can be placed onto the desired fingernail. While the tab 132 is illustrated at a proximal end of the fingernail covering, other configurations are possible. For example, in some embodiments, one or more tabs 132 can be disposed along the side regions 101 of the fingernail covering. In some cases, arranging the tab 132 near the stiffer tip extension may help to make the liner layer 130 easier to remove.

Figure 17:
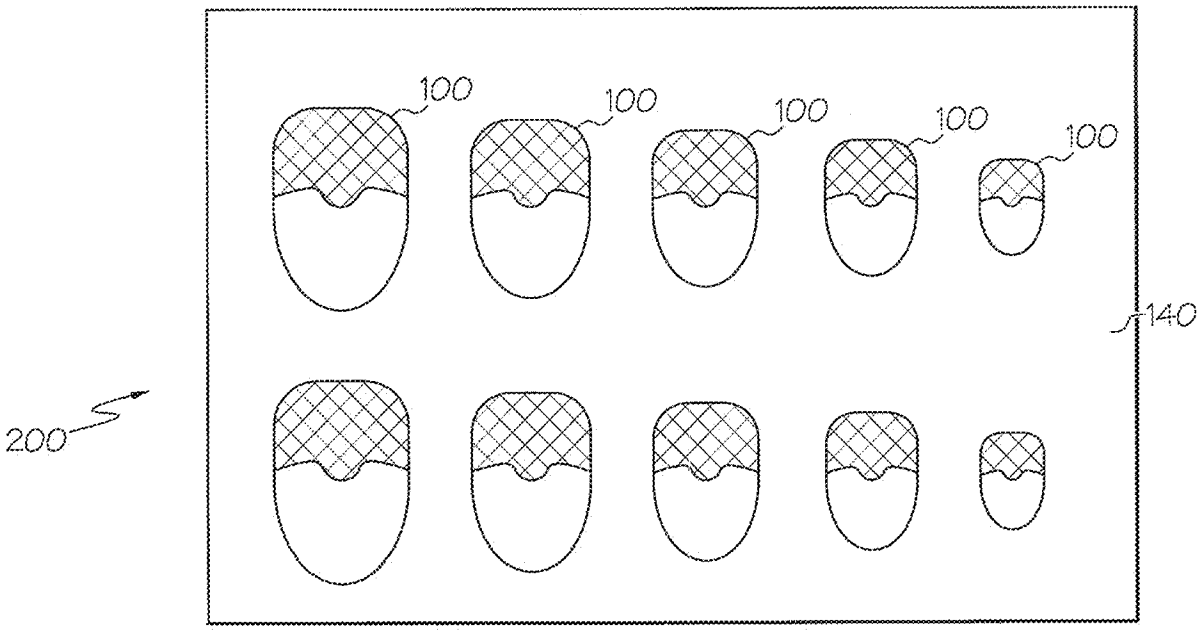
FIG. 17 is a top view of an example assembly of multiple fingernail covering packaged together with one another.
Figure 18:
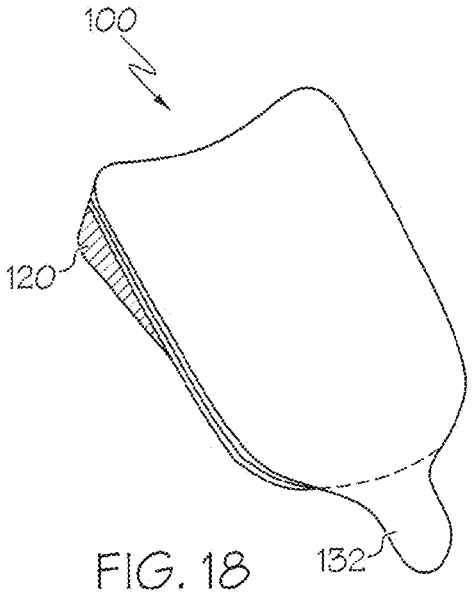
FIGS. 18-23 illustrate example sequential steps for applying a fingernail covering to a natural fingernail.

Other types of removable layers are possible. For example, referring to FIG. 17, multiple fingernail coverings 100 can be manufactured or merely packaged in the form of a kit or an assembly 200 along a sheet 140 that can be made of a removable liner layer material configured to permit release of the sticker layer 110 and/or the tip extension 120.

In some embodiments, the removable layer (e.g., the layer 130 and/or the sheet 140) can be made from one or more of plastics, papers, or other suitable materials and have a surface that is in contact with the sticker layer 110 or the tip extension 120 and is configured for easy removal thereof when pulled by the user.

Figure 19:
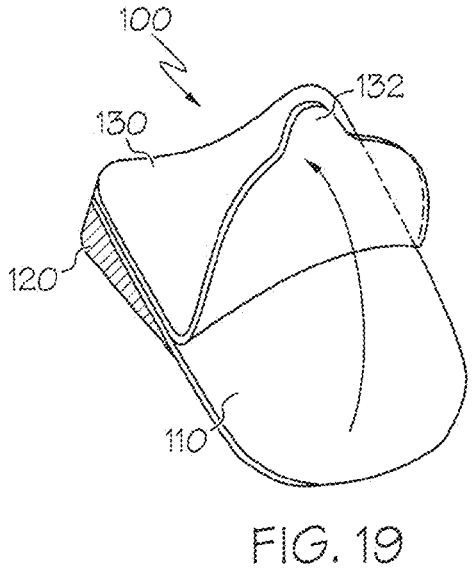

The fingernail coverings described herein can be installed (e.g., applied to a fingertip) in any number of various ways. An example application method is illustrated and depicted in FIGS. 18-23. For example, the fingernail covering 100 can first be removed from the removable liner layer 130. As illustrated in FIG. 19, in some embodiments, the removable layer 130 can be gripped by the tab 132 and pulled from the adhesive surface of the sticker layer 110 and/or the tip extension 120. However, as discussed above, in some embodiments, the removable layer can be in the form of a sheet 140 and the fingernail covering can be removed (e.g., peeled) from the sheet 140.

Figure 20:
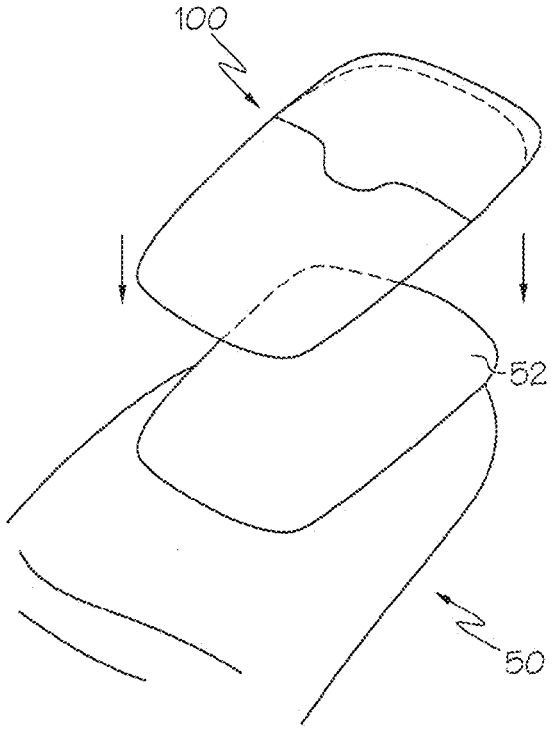
Figure 21:
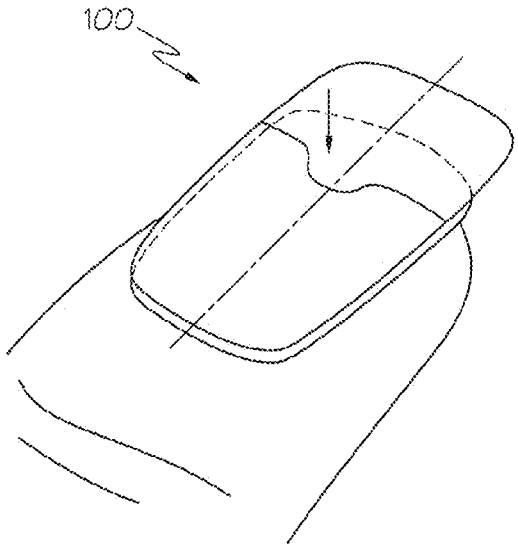

As illustrated in FIG. 20, the fingernail covering 100 can be lowered and placed onto the natural fingernail 52 of a user's finger 50. Referring to FIG. 21, pressure can be applied to the fingernail covering to begin adhering (e.g., sticking) the sticker layer to the fingernail. For example, the user can press on a region (e.g., a central region) of the fingernail covering. In some cases, the user can press onto the central region of the tip extension (e.g., along a central protruding region). Pressure can be applied to the central region of the fingernail covering to help limit bubbles or wrinkles from forming between the sticker layer and the fingernail during application.

Figure 22:
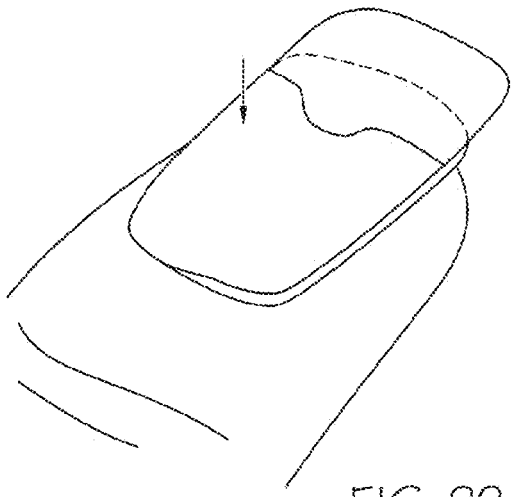
Figure 23:
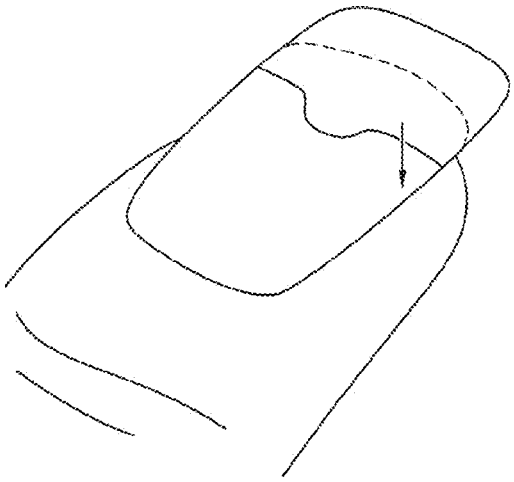

Referring to FIGS. 22 and 23, pressure can then be applied to outer (e.g., side) regions of the fingernail covering to adhere the sticker layer to the fingernail. For example, with the central region stuck to the fingernail, the user can work outwardly to apply pressure by moving their finger outwardly along the fingernail covering to smooth out the fingernail covering along the fingernail. In some cases, one side can be pressed-on and adhered to the fingernail and then the other (e.g., opposite) side can be pressed-on and adhered to the fingernail. In some cases, both side regions can be smoothed out and applied at the same time. However, other application methods are also possible.

While the fingernail coverings described herein have generally been described as being applied over a fingernail by first aligning a distal end of the fingernail covering with a cuticle of a natural nail, other configurations are possible. For example, in some embodiments, the fingernail coverings may be applied over a natural nail such that a portion of the sticker layer overlaps the cuticle of the natural nail and can temporarily cover a portion of the non-nail region of the finger (e.g., skin). Then, the overlapping portion of the sticker layer may be trimmed so that sticker can be pressed and smoothed along the natural nail up to the cuticle.

While various embodiments have been described herein, it should be understood that they have been presented and described by way of example only, and do not limit the claims presented herewith to any particular configurations or structural components. Thus, the breadth and scope of a preferred embodiment should not be limited by any of the above-described exemplary structures or embodiments, but should be defined only in accordance with the following claims and their equivalents. Other embodiments are within the scope of the following claims.

What is claimed:

1. A fingernail covering comprising:

a first flexible sticker sheet layer configured to at least partially conform to and cover a fingernail from a cuticle region at a proximal end to a distal end of the fingernail, the first flexible sticker sheet layer defining a first surface;

a fingernail tip extension disposed along a distal end region of the first flexible sticker sheet layer and along the first surface of the first flexible sticker sheet layer, the tip extension comprising:

a protruding region that extends proximally along the first flexible sticker sheet layer away from a distal end of the fingernail covering, the protruding region extending proximally away from a remaining region of the fingernail tip extension for maintaining structural integrity of the fingernail covering and placement of the fingernail covering along the fingernail; and a second flexible sticker sheet layer disposed along the first surface of the first flexible sticker sheet layer and a surface of the tip extension that is opposite a surface of the tip extension that is attached to the first flexible sticker sheet layer, wherein a material stiffness of the fingernail tip extension is greater than a material stiffness of the flexible sticker sheet layers, wherein the fingernail tip extension defines a length direction extending from the proximal end to the distal end of the fingernail, and a width direction substantially perpendicular to the length direction, and wherein the fingernail tip extension has a thickness varying along the width direction.

2. The fingernail covering of claim 1 wherein the tip extension has a surface area that is about 15% to about 50% of a surface area of the first flexible sticker sheet layer.

3. The fingernail covering of claim 2 wherein the tip extension has a surface area that is about 25% to about 40% of a surface area of the first flexible sheet sticker layer.

4. The fingernail covering of claim 1 wherein the tip extension has a maximum thickness that is about 0.002 inches to about 0.05 inches.

5. The fingernail covering of claim 4 wherein the maximum thickness is located at the distal end of the fingernail covering.

6. The fingernail covering of claim 1 wherein the protruding region extends along a central region of the fingernail covering.

7. The fingernail covering of claim 1 wherein the protruding region extends from a remaining region of the tip extension by about 5% to about 15% of a length of the fingernail.

8. The fingernail covering of claim 1 wherein the protruding region has a generally curved shape.

9. The fingernail covering of claim 1 wherein the flexible sticker sheet layers have a generally uniform thickness.

10. The fingernail covering of claim 9 wherein a ratio of an end thickness of the tip extension to the generally uniform thickness of the flexible sticker sheet layers is about 2:1 to about 5:1.

11. The fingernail covering of claim 1 further comprising a removable layer disposed along an adhesive surface of the second flexible sticker sheet layer that is opposite a surface of the second flexible sticker sheet layer that is attached to the first flexible sticker sheet layer and the tip extension.

12. The fingernail covering of claim 11 wherein the removable layer includes one or more tab regions configured to be gripped to remove the removable layer from the second flexible sticker sheet layer.

13. The fingernail covering of claim 1 wherein the first flexible sticker sheet layer covers only a portion of the tip extension and/or the second flexible sticker sheet layer.

14. A fingernail covering comprising:

a first flexible sticker sheet layer configured to conform to and cover at least a portion of a fingernail, the first flexible sticker sheet layer defining a first surface;

a fingernail tip extension disposed along an end region of the first flexible sticker sheet layer; and a second flexible sticker sheet layer disposed along the first surface of the first flexible sheet layer and a surface of the tip extension that is opposite a surface of the tip extension that is attached to the first flexible sheet layer, wherein the second flexible sticker sheet layer is configured to adhere to at least a portion of the fingernail, wherein the fingernail tip extension defines a length direction extending from the proximal end to a distal end of the fingernail, and a width direction substantially perpendicular to the length direction, and wherein the fingernail tip extension has a thickness varying along the width direction.

15. The fingernail covering of claim 14 wherein the tip extension has a surface area that is about 15% to about 50% of a surface area of the first flexible sheet layer.

16. The fingernail covering of claim 15 wherein the tip extension has a surface area that is about 25% to about 40% of a surface area of the first flexible sheet layer.

17. The fingernail covering of claim 14 wherein the tip extension has a maximum thickness located at a distal end of the fingernail covering that is about 0.002 inches to about 0.05 inches.

18. The fingernail covering of claim 14 wherein the tip extension comprises one or more generally curved protruding regions that extend proximally along the first flexible sheet layer away from a distal end of the fingernail covering.

19. The fingernail covering of claim 18 wherein one of the protruding regions extends along a central region of the fingernail covering.

20. The fingernail covering of claim 18 wherein the protruding region has a width that is about 15% to about 50% of a total width of the fingernail covering.

21. The fingernail covering of claim 14 wherein an elastic modulus of the fingernail tip extension is greater than an elastic modulus of the flexible sheet layers.

22. The fingernail covering of claim 14 wherein a ratio of a maximum thickness of the tip extension to a generally uniform thickness of the flexible sheet layers is about 2:1 to about 5:1.

23. The fingernail covering of claim 14 further comprising a removable liner layer disposed along an adhesive surface of the second flexible sticker sheet layer that is opposite a surface of the second flexible sticker sheet layer that is attached to the first flexible sticker sheet layer and the tip extension.

24. An assembly comprising:

a liner sheet; and a plurality of fingernail coverings releasably disposed along the liner sheet, at least one of the plurality of fingernail coverings comprising:

a first flexible sticker sheet layer configured to conform to and cover at least a portion of a fingernail, the first flexible sticker sheet layer defining a first surface;

a fingernail tip extension disposed along an end region of the first flexible sticker sheet layer; and a second flexible sticker sheet layer disposed along the first surface of the first flexible sheet layer and a surface of the tip extension that is opposite a surface of the tip extension that is attached to the first flexible sheet layer, wherein the second flexible sticker sheet layer is configured to adhere to at least a portion of the fingernail, wherein the fingernail tip extension defines a length direction extending from the proximal end to a distal end of the fingernail, and a width direction substantially perpendicular to the length direction, and wherein the fingernail tip extension has a thickness varying along the width direction.

* * * * *